US008881807B1

(12) United States Patent
Orentlikherman et al.

(10) Patent No.: US 8,881,807 B1
(45) Date of Patent: Nov. 11, 2014

(54) AUTONOMOUS APPARATUS TO RESTORE AND MAINTAIN WELL PRODUCTIVITY AND METHOD OF USING THE SAME

(71) Applicants: Ernest Orentlikherman, Moscow (RU); Isaak Orentlikherman, Moscow (RU)

(72) Inventors: Ernest Orentlikherman, Moscow (RU); Isaak Orentlikherman, Moscow (RU)

(73) Assignee: Well-Smart Technologies—Global, Inc, Reno, NV (US)

( * ) Notice: Subject to any disclaimer, the term of this patent is extended or adjusted under 35 U.S.C. 154(b) by 0 days.

(21) Appl. No.: 14/218,533

(22) Filed: Mar. 18, 2014

(51) Int. Cl.
*E21B 28/00* (2006.01)
*E21B 47/09* (2012.01)

(52) U.S. Cl.
CPC ..... *E21B 28/00* (2013.01); *E21B 47/09* (2013.01)
USPC ..... 166/249; 166/311; 166/177.2

(58) Field of Classification Search
CPC ..... E21B 28/00; E21B 43/003; E21B 44/005; E21B 31/005
USPC ..... 166/249, 311, 177.1, 177.2
See application file for complete search history.

(56) References Cited

U.S. PATENT DOCUMENTS 6,009,948 A * 1/2000 Flanders et al. ..... 166/301
6,296,066 B1 * 10/2001 Terry et al. ..... 175/92
2004/0003658 A1 * 1/2004 Han et al. ..... 73/152.47

FOREIGN PATENT DOCUMENTS

WO WO2007/061333 * 5/2007 ..... E21B 43/25

* cited by examiner

*Primary Examiner* — Cathleen Hutchins
(74) *Attorney, Agent, or Firm* — Nadya Reingand; Yan Hanking

(57) ABSTRACT

Disclosed herein is an autonomous and consistently active acoustic rehabilitation technology for wells, reservoirs, and extraction of natural resources using a borehole method. The invention can be used in oil, gas, mining, geological exploration industries, and in extraction technologies for oil and gas, including shale. It is especially useful for improvement of oil and gas output from wells and stimulation of production for maximizing recovery from reserves. The invention is applicable to areas including, but not limited to, well reserves using pumps, layer pressure supporting wells, and offshore-bed wells.

20 Claims, 2 Drawing Sheets

AUTONOMOUS APPARATUS TO RESTORE AND MAINTAIN WELL PRODUCTIVITY AND METHOD OF USING THE SAME

CROSS-REFERENCE TO RELATED APPLICATIONS

This patent application claims priority to, and incorporates fully by reference, U.S. Provisional Patent Application No. 61/802,846, filed Mar. 18, 2013 (Autonomous apparatus to restore and maintain a well productivity and method of using the same).

FIELD OF THE INVENTION

The invention primarily relates to the oil and natural gas industries and can be used to restore and maintain productivity of a well.

BACKGROUND OF THE INVENTION

Several known methods of cleaning and maintaining the production of wells existing today are discussed below. This known art, and particularly the acoustic methods disclosed, is incorporated herein fully by reference.

A known method of vibrating the bottomhole zone of a well has been disclosed (Patent RU 2109134, E 21 B 43/25), comprising lowering an acoustic device, which is a structural component of the underground processing equipment, into a well.

Another known method of stimulating oil production exists (Patent RU 2133332, E 21 B 43/00, E 21 B 43/25), comprising lowering pumping equipment and an acoustic vibration generator into a well.

Another known method of vibrating the bottom-hole zone of a well, an acoustic device for a well, has been disclosed (Patent RU 2301329), comprising a structural element of underground technological equipment.

Another known method for stimulating recovery of natural resources, ACOUSTIC METHOD OF ACTION ON WELL AND FORMATION OF MINERAL DEPOSITS "ARSIP" (Patent RU 2143554), has also been disclosed.

Another known method for stimulating oil production, VIBRATION SYSTEM FOR OIL AND GAS WELLS (Patent Ru 2202038), also exists.

The current existing equipment and methods of affecting wellbore fluid have numerous drawbacks, including:

The inability to direct a selective effect on well perforations and formations;

The lack of effective application in active wells and the subsequent start of a well, on which a suspended pumping installation is mounted;

The inability to implement a signal (e.g., acoustic) emitter in an autonomous mode due to the connection required between the emitter and a control unit via, e.g., a load-bearing cable;

The inability to accurately determine the location of an emitter during autonomous operation;

And the lack of automatic adjustment and control of the vibration and parameter recording in autonomous mode.

SUMMARY OF THE INVENTION

Disclosed herein is a wireless, self-sustaining, and self-governing acoustic device and method of using the acoustic device within a well for restoring and maintaining well productivity. The device comprises acoustic units with acoustic emitters for signaling a complex acoustic effect, various sensor units (at least one), a control and information processing unit, a power source/supply, and a mechanism for movement along the well. Additional aspects of the device include geophysical characteristic sensors for determining the surrounding environment, memory units for storing information and various operational programs, a locking mechanism, and one or more centralizers for even positioning. The method of using the device comprises lowering the device into a wellbore and allowing it to operate on its own by obtaining readings regarding the well/underground environment, determining programs of acoustic signal emission based on the readings, determining optimal positioning alongside perforations of the wellbore and/or specific interlayers of the reservoir, and emitting acoustic effects to clean and maintain the wellbore and surrounding production formation without the need for an operator.

BRIEF DESCRIPTION OF THE DRAWINGS

FIG. 2(*a*) shows the strata before acoustic application, FIG. 2(*b*) shows the same strata after acoustic application.

DETAILED DESCRIPTION OF THE PREFERRED EMBODIMENT

Figure 1:
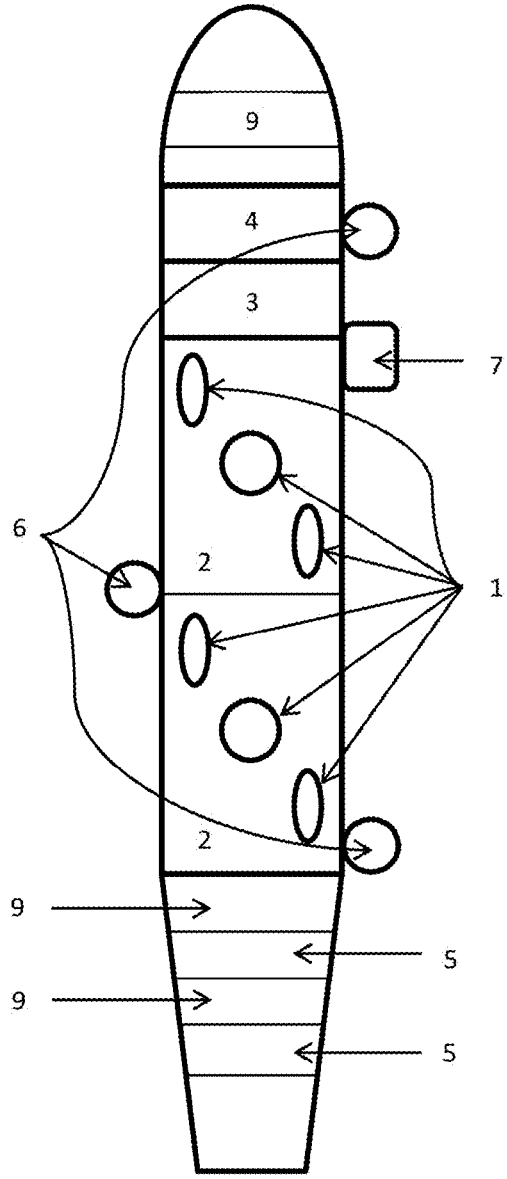
FIG. 1 shows an example of the various components of one embodiment of the acoustic device.
Figure 2:
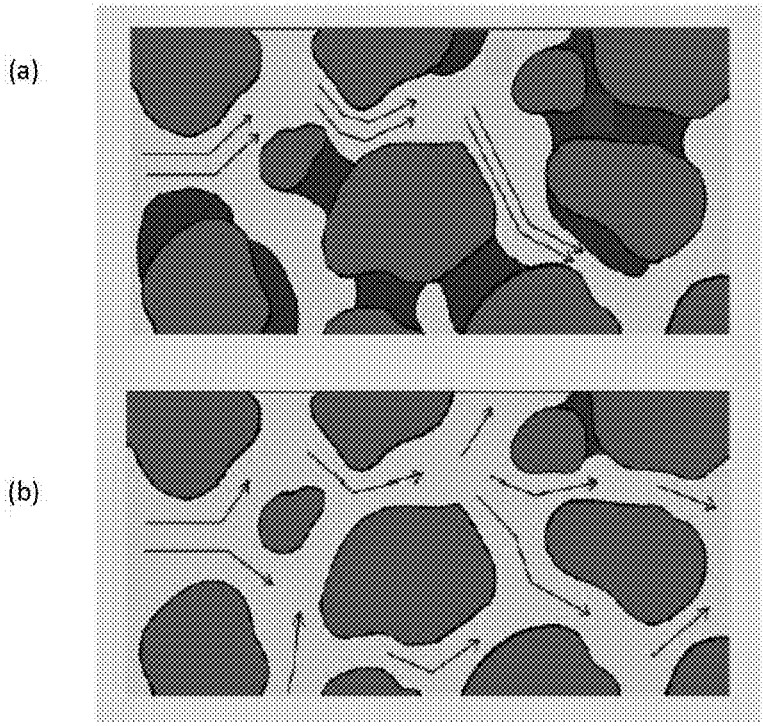
FIG. 2 shows how the complex acoustic effect created by the present invention fragments clogging particles and solids within the well, thus restoring and maintaining optimal productivity. The arrows illustrate the flow of fluid/gas.

The present invention relates to extraction of natural resources using a borehole method and can be used in oil, gas, mining, geological exploration industries, and in extraction technologies for oil and gas, including shale. It is especially useful for rehabilitation projects on wells and reservoirs (Well and Reservoir Acoustic Rehabilitation—WRAR) in order to improve oil and gas output from the wells and stimulate production for maximizing recovery from reserves.

The claimed method comprises emitting complex acoustic vibrations on the perforated zones of a well, at specific interlayers of a well, and/or on the filters in horizontal wells. The perforated interval and productive strata of the reservoir are thus sequentially and specifically treated with a directed acoustic field. The pressure, time, and range of the acoustics are correlated and applied in various combinations depending on detected characteristics of the specific well and the formation within the well. Signals in the audible and ultrasound ranges, with 360 degree directional characteristics (i.e. in all directions), provide acoustic pressures from a minimum value, necessary to cause changes in an active production well, to a maximum value, which is limited by the elasticity and other characteristics of the formation. The duration of the exposure is based on the effective exposure time, which also depends on characteristics of the individual well and the formation within it. The acoustic effect has an effective exposure range starting from 0.05 meters and is limited only by the geological characteristics of the formation. Acoustic effects can be created in a basic mode—with sequential processing of the wellbore production strata interval using different phases of acoustic signals (emitted from, e.g., 3 types of acoustic emitters 1). Various combinations of these signal sequences (and various numbers of acoustic emitters) are employed based on the task at hand and the desired outcome (e.g. maintenance versus restoration). The method allows for a unified complex effect on all types of wells with various means of operation, wherein the wells are either in operating/active or inoperative/inactive conditions.

Any number of phase locked emitters may be employed. However, our experiments show that at least three emitter must be installed for efficient operation of the device. Another embodiments of the device include 6, or 9, or 12 emitters. In the preferred embodiment, the device operates with 9 emitters.

A critical target for effective well operations is the nearest bottomhole formation (BHF) zone acoustically accessible through well perforations or through technological filtration apertures in horizontal wells. This zone, ranging in depth from one centimeter to 1.5 meters from the well wall, is referred to as the hydrodynamic flow zone. The hydrodynamic flow zone is characterized by maximum fluid filtration speeds.

In the hydrodynamic flow zone, the difference between the formation (reservoir) pressure and bottomhole pressure, produced by the pump of a well, is, by itself, insufficient for maintaining stable filtration for long durations of time.

The filtration process in the BHF zone is always slower compared to potential values in the absence of structured systems/objects (e.g., clogging from salts, carbonates, waxes, and the like). This leads to, e.g., decreased well productivity, an increased water amount in oil production, and decreased gas recovery from a formation. This is further evident in the fact that if the structure collapses, breaks down, is removed, etc., the filtration rate returns to values corresponding to Darcy's Law.

A constant pressure gradient, produced by the pump in the well, is insufficient for pumping/forcing the layer of clogging or colloidal fluid out of the well. The requirements for generating such pressure are technically difficult: therefore, the best method to restore the original properties of the BHF zone comprises breaking (fragmenting) the clogging or colloidal fluid in a constant and autonomous manner during normal well operation. Such constant fragmentation is achieved via the acoustic methods described herein, occurring at the level of micro-particles (on the scale of thousandths of a millimeter).

The present invention provides a consistent and autonomous source of acoustic vibrations for the restoration and maintenance of a well, and particularly the BHF zone. Considering the wide spectrum of potential acoustic fields described in this and previously disclosed methods, the effect is limited only by the particular liquid/formation within a well.

The present invention eliminates the above-mentioned disadvantages and increases oil and gas recovery from formations by the processing of a production formation interval by autonomous acoustic emitters, located and moving within the operating well. The present invention provides conditions under which it is possible, in production wells to:

Achieve the most complete and thorough cleaning possible at the BHF zone of oil wells, eliminating, e.g., clogging substances and solids;

Reduce fluid viscosity;

Increase recovery of well product and overall well activity and capabilities including, but not limited to, oil output (liquid output is increases range from 90 percent to 500 percent), well injection capacity, water cut proportion, operating capacity of the formation during shale gas production in horizontal wells, quality and rate of chemical processes associated with releasing natural gas from shale formation deposits, and cleanliness of the fissure's hydrodynamic discharge zones, containing proppant (ceramic sand):

Degas wellbore fluid during the active process of well operation;

And increase the service life of gas wells (the effect of one treatment can last from 6 months to more than 2 years, but note that the method described herein can be continuous).

No losses result from idle wells during the cleaning/maintaining process disclosed in the present invention. No requirement exists to stop a well before a subsequent vibration, thus entirely eliminating declines in production and any additional round trip operations. Thus, the presently claimed method permits full recovery of well production and supports long-term productivity at a current and consistent level without any additional material or time costs associated with carrying out timely and beneficial vibrations for maintaining the well.

The acoustic effect is generated by an acoustic device (see FIG. 1). The acoustic device comprises up to three (3) acoustic units 2, each comprising acoustic emitters 1 for creating a complex acoustic effect, a control and data processing unit 3, a power source 4 for independent operation without the need for any cable or connecting electrical wire, and a means for movement along the wellbore 6. One preferred embodiment comprises three such acoustic emitters per acoustic unit. It is noted, however, that each acoustic unit can have any number of acoustic emitters, so long as a phase differential among emitters is achieved (i.e. the entire acoustic devices comprises at least two acoustic emitters). The acoustic device further comprises several types of sensors (but at least one) for reading parametric data of the wellbore and the surrounding production formation of the reservoir. The types of sensors include, but are not limited to, a thermobaric ring (downhole temperature/pressure gage (DTPG) ring), a pressure sensor, a temperature sensor (thermometer), a gyroscope (or any other known type of location sensor), a vibration sensor, a sound level sensor, a fluid content sensor, a gas content sensor, a fluid-gas content sensor, a flow meter, a position sensor, a direction sensor, and a rotation sensor. The control and processing unit 3 receives and processes the parametric data obtained by the sensor(s) 5. The control and processing unit 3 further determines specific programs of operation for the 7 acoustic device based on the parametric data of the wellbore and reservoir. Additionally, the control and processing unit determines the optimal positioning (including but not limited to rotational positioning and wellbore positioning) of the acoustic device along specifically desired interlayers of the formation and/or perforated formation zones. The means for movement along the wellbore 6 include, but are not limited to, caterpillar tracks, legs, a propeller, or wheels (although FIG. 1 illustrates circular structures, it is not meant to limit such means for movement to circular structures—any shape and any similar or known means for movement can be employed). The means for movement 6 can also be coupled with a rigid locking mechanism (i.e. means for rigid locking) when a desired position along the wellbore is reached, thus allowing for targeted acoustic vibrations while allowing the acoustic device itself to remain in a sturdy position during signal emission.

In other embodiments, the control and processing unit 3 further comprises a memory unit for storage of specified programs corresponding to different modes of operation. Such programs are created by the control and processing unit 3 based on the parametric data obtained by the sensor(s) 5. The programs are stored in the memory unit for deployment when similar parameters are detected as the acoustic device moves into further/deeper locations along the wellbore.

Further embodiments of the present invention include a solid state memory unit within each individual sensor 5, which stores specific programs from specific sensors, thus allocating certain actions and effects based on specific readings (e.g., from the thermobaric ring only, from the fluid gas content sensor only, from the gyroscope only, etc.).

Other embodiments of the present invention further comprise one or more mechanical centralizer(s) 9 for positioning the device at equidistant lengths within the wellbore, e.g., equal lengths from each wall of the well, thus allowing for an evenly distributed acoustic signal during operation. The acoustic device can additionally be equipped with a rotating means 7 for turning the device about its own axis, thus allowing for 360 degree release of acoustic signal into the well and maintaining all surrounding portions of the formation particles and wellbore.

The acoustic device, or several such devices, is submerged into the well at the same time as the underground equipment of the well is installed. The acoustic device remains in the well throughout the well's operational lifetime, continuously, consistently, and autonomously cleaning, restoring, and maintaining the productivity of the well via complex acoustic vibrational effect. Alternatively, the device(s) is (are) is submerged during repair of a well prior to restarting well production. If the well comprises a pump, the acoustic device is submerged before the pump is submerged (otherwise, it can be submerged/inserted at any time). The acoustic device operates and installs itself autonomously in perforated formation zones or selected interlayers and is able to affect the production formation zone via acoustic effect/vibration, thus fragmenting solid particles that cause clogging and less-than-optimal productivity of the well. The acoustic device is wireless and acts independently of any connecting cable or wire, receiving initial signals, if needed, via, e.g., radio waves and creating and storing various programs of operation based on its own collected and processed parametric readings for autonomous operation deeper within the well.

Figure 3:
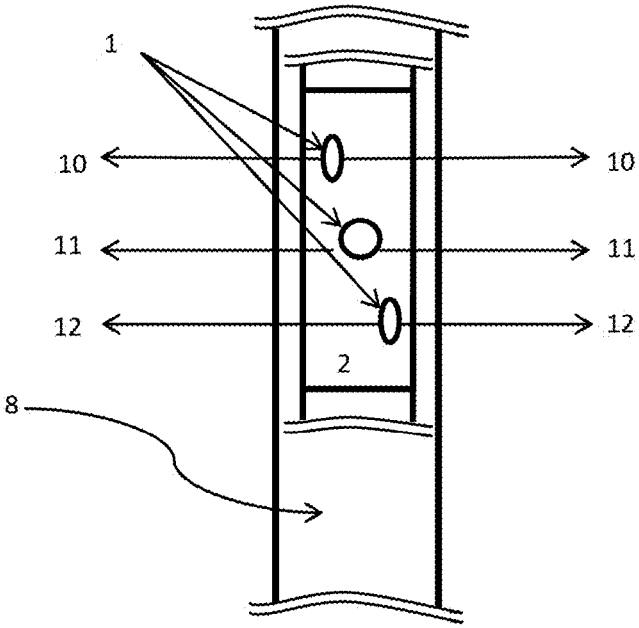
FIG. 3 shows the perpendicular direction of the acoustic waves created by the acoustic emitters of each acoustic unit of the claimed device and method.

The specific characteristics of the acoustic effects (e.g., frequency, power, directional orientation, effect pattern) are determined and varied in the well operation process (by the control and processing unit 3) depending on parametric data obtained by the sensors 5 coupled to the acoustic device. This data is then processed by a program/software installed 9 on the control and processing unit 3, which determines and initiates the corresponding mode(s) of operation relative to the geophysical characteristics of the collector and the fluid within the well as well as the particles and makeup of the production formation (reservoir). The complex acoustic effect is accomplished by each individual acoustic unit 2 (see FIG. 3). In the example of FIGS. 1 and 3, each acoustic unit 2, comprises three acoustic emitters 1, each of which is positioned such that the acoustic signal released is a phase locked signal which is emitted in a direction perpendicular, or at least predominantly perpendicular directions 10,11,12, to the well or wellbore 8. "Phase locked" means that the phase of each individual signal emitted by each individual emitter is calculated, by the control and processing unit 3, to produce an optimal unclogging cumulative acoustic effect. Such an effect is achieved by (1) positioning the acoustic emitters and/or (2) emitting specific signals at various specific intervals of time in such a way that the phases of each acoustic wave emitted combine to produce an optimal vibration of the well. The release of the acoustic signal is calculated and controlled by the control and processing unit based on the information obtained by the sensor(s) of the device.

Additionally, the acoustic device is powered by an independent source of power 4 located within the device and comprises a mechanism for moving along the well 6 and about the device's own axis 7 for optimal positioning opposite the necessary intervals and in the correct direction.

Maintaining long term well productivity also includes using standard underground equipment (e.g., pump-compressor tubing, rod hydraulic pumps, electro-centrifugal pumps, and other equipment), which is lowered into the well when the well is operational/active. This pumping equipment causes an increase in the useful lifetime of the underground equipment of the well due to a decreased buildup of deposits. Such pumps must hang above the perforations, so as not to create an excessive pressure in the zone below the level of fluid in the wellbore in order to not pump any air, otherwise the well can burn or become jammed. When clogging solids enter such pumps and create a jam, all such equipment must be removed in order to repair the well (a costly process). The claimed invention also presents a solution to this potential problem by maintaining an acoustic effect and acoustic field in the perforated zones of the well, thus not allowing such clogging solids/particles to form and, in turn, increasing the life of such pumping equipment in addition to the well itself.

The claimed method can be applied to alter other presently known devices with general industrial applications, and particularly those devices which create acoustic pressure on the well and on the production formation over a wide range of signal characteristics, as well as those devices which create direct acoustic vibration of the fluid in the well and the production formation.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalent.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What is claimed is:

1. A method for autonomously restoring the productivity of a well, comprising:

submerging at least one wireless, self-sustaining, and self-governing acoustic device having on board power supply which provides a totality of the energy necessary for the acoustic device to operate independently into a wellbore, said at least one acoustic device comprising up to three acoustic units comprising phase locked acoustic emitters, at least one sensor, a control and processing unit, an independent power supply, and a means for movement along said wellbore, obtaining a reading of parametric data of a surrounding environment via said at least one sensor, processing said parametric reading by said control and processing unit of said generator, and initiating a corresponding mode of operation, said mode of operation including phase relations between said acoustic emitters, via said control and processing unit, comprising emitting an acoustic signal transmitting predominantly perpendicular to the well during a standard operation of said well, thus creating an acoustic vibration of said wellbore and a formation surrounding said wellbore due to a cumulative effect of phase locked acoustic waves for removal and fragmentation of clogging particles from said wellbore and formation surrounding said wellbore.

2. The method according to claim 1, wherein said control and processing unit further comprises a memory unit for storage of at least two specified programs corresponding to different modes of operation of said acoustic device to produce vibrations based on parametric data obtained by said at least one sensor.

3. The method according to claim 1, further comprising equipping said acoustic device with a downhole temperature/pressure gage (DTBG) ring comprising sensors to measure temperature and pressure for precise determination of a location of fluid motion from said formation into said wellbore.

4. The method of claim 3, further comprising equipping said acoustic device with a solid state memory unit for recording programs corresponding to different operating modes of said acoustic device based on a parametric reading of a surrounding environment obtained by said downhole temperature/pressure gage (DTBG) ring wherein said acoustic device produces vibrations.

5. The method according to claim 1, further comprising equipping said acoustic device with at least one fluid gas composition sensor for control of degassing modes during deployment of said acoustic device in shale gas wells.

6. The method of claim 5, further comprising equipping said acoustic device with a solid state memory unit for recording programs corresponding to different operating modes of said acoustic device based on parametric reading of a surrounding environment obtained by said at least one fluid gas composition sensor.

7. The method according to claim 1, further comprising equipping said acoustic device with a gyroscope for precise measurement of a position of said acoustic device within said well.

8. The method of claim 7, further comprising equipping said acoustic device with a solid state memory unit for recording programs corresponding to different operating modes of said acoustic device based on a parametric reading of a surrounding environment obtained by said gyroscope wherein said acoustic device produces vibrations.

9. The method according to claim L, wherein said control and processing unit determines a location of a required processing interval and said means for movement positions said acoustic device opposite said required processing interval.

10. The method according to claim 1, wherein said means for movement allows said acoustic device to remain in the sturdy position during signal emission wherein said acoustic device produces vibrations.

11. The method according to claim 1, further comprising equipping said acoustic device with at least one mechanical centralizer for positioning said device at an equidistant length from each wall of said well, thus creating evenly distributed acoustic waves during operation wherein said acoustic device produces vibrations.

12. The method according to claim 1, wherein said acoustic device turns about its own axis, allowing for 360 degree release of acoustic signal into the well and maintaining all surrounding portions of the formation particles and wellbore.

13. The method according to claim 1, further comprising equipping said acoustic device with a solid state memory unit for recording programs corresponding to different operating modes of said acoustic device based on the parametric data of a surrounding environment obtained by said at least one sensor wherein said acoustic device produces vibrations.

14. The method according to claim 1, further comprising equipping said acoustic device with a solid state memory unit for recording data regarding operation parameters of said acoustic device for subsequent analysis after removal of said device from said well wherein said acoustic device produces vibrations.

15. The method according to claim 1, wherein said control and processing unit autonomously controls a movement of said acoustic device along said well, installs said device at required perforation intervals, and rotates said device wherein said acoustic device produces vibrations.

16. The method of claim 1, further comprising operating said acoustic device continuously throughout said well's useful life, thus maintaining a higher productivity of said well.

17. A wireless, self-sustaining, and self-governing acoustic device having on board power supply which provides a totality of the energy necessary for the acoustic device to operate independently downhole for restoring the productivity of a well, comprising: up to three acoustic units comprising phase locked acoustic signal emitters, wherein said phase locked acoustic signal emitters, with phase relations between said emitters, release a predominantly perpendicular acoustic signal during a standard operation of said well, thus creating an acoustic vibration of said wellbore and a formation surrounding said wellbore due to a cumulative effect of phase locked acoustic waves for removal and fragmentation of clogging particles, at least one sensor unit for obtaining parametric data, a control and processing unit, wherein said control and processing unit processes parametric data of a surrounding medium obtained by said at least one sensor, wherein said control and processing unit further initiates a corresponding apparatus operation based on said obtained parametric data, at least one independent power source, and a means for movement along said wellbore.

18. The apparatus of claim 17, wherein each acoustic unit comprises at least three acoustic signal emitters, each said acoustic signal emitter releasing an acoustic signal in a different phase, thus creating a complex acoustic effect upon said wellbore and surrounding medium.

19. The apparatus of claim 17, further comprising a memory unit for storage of at least two specified programs corresponding to different modes of operation of said apparatus based on parametric data obtained by said at least one sensor wherein said acoustic device produces vibrations.

20. The apparatus of claim 17, further comprising at least one mechanical centralizer for positioning said device at an equidistant length from each wall of said well, thus creating an evenly distributed cumulative acoustic effect during operation wherein said acoustic device produces vibrations.

* * * * *